US006306232B1

(12) United States Patent
Khandhadia et al.

(10) Patent No.: US 6,306,232 B1
(45) **Date of Patent: *Oct. 23, 2001**

(54) THERMALLY STABLE NONAZIDE AUTOMOTIVE AIRBAG PROPELLANTS

(75) Inventors: Paresh S. Khandhadia, Troy; Sean P. Burns, Ann Arbor, both of MI (US)

(73) Assignee: Automotive Systems Laboratory, Inc., Farmington Hills, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/851,503

(22) Filed: May 5, 1997

Related U.S. Application Data

(63) Continuation-in-part of application No. 08/681,662, filed on Jul. 29, 1996, now abandoned.

(51) Int. Cl.[7] ..... C06B 47/10
(52) U.S. Cl. ..... 149/22
(58) Field of Search ..... 149/47, 36, 46

(56) References Cited

U.S. PATENT DOCUMENTS

| | | | | |
|---|---|---|---|---|
| 2,434,872 | * | 1/1948 | Taylor et al. | 149/47 |
| 2,963,356 | | 12/1960 | Guth | 52/0.5 |
| 3,180,772 | * | 4/1965 | O'Connor et al. | 149/47 |
| 3,719,604 | | 3/1973 | Prior et al. | 252/186 |
| 3,720,553 | * | 3/1973 | Henderson | 149/47 |
| 3,739,574 | * | 6/1973 | Godfrey | 60/39.03 |
| 3,954,528 | | 5/1976 | Chang et al. | 149/19.4 |
| 4,111,728 | | 9/1978 | Ramnarace | 149/19.5 |
| 4,234,363 | | 11/1980 | Flanagan | 149/19.4 |
| 4,300,962 | | 11/1981 | Stinecipher et al. | 149/47 |
| 4,421,578 | * | 12/1983 | Voreck | 149/47 |
| 4,552,598 | * | 11/1985 | Lee et al. | 149/47 |
| 4,552,736 | | 11/1985 | Mishra | 423/266 |
| 4,925,503 | | 5/1990 | Canterberry et al. | 149/19.4 |
| 4,925,600 | | 5/1990 | Hommel et al. | 264/3.4 |
| 4,931,112 | | 6/1990 | Wardle et al. | 149/88 |
| 4,948,439 | | 8/1990 | Poole et al. | 149/46 |
| 5,034,072 | | 7/1991 | Becuwe | 149/19.4 |
| 5,035,757 | | 7/1991 | Poole | 149/46 |
| 5,074,938 | | 12/1991 | Chi | 149/21 |
| 5,076,938 | | 12/1991 | Noonan et al. | 210/708 |
| 5,125,684 | | 6/1992 | Cartwright | 280/736 |
| 5,139,588 | | 8/1992 | Poole | 149/61 |
| 5,197,758 | | 3/1993 | Lund et al. | 280/741 |
| 5,198,046 | | 3/1993 | Bucerius et al. | 149/61 |
| 5,292,387 | * | 3/1994 | Highsmith et al. | 149/19.1 |
| 5,386,775 | | 2/1995 | Poole et al. | 102/289 |
| 5,439,251 | | 8/1995 | Onishi et al. | 280/741 |
| 5,472,647 | | 12/1995 | Blau et al. | 264/3.1 |
| 5,482,579 | * | 1/1996 | Ochi et al. | 149/83 |
| 5,500,059 | | 3/1996 | Lund et al. | 149/19.1 |
| 5,501,823 | | 3/1996 | Lund et al. | 264/3.1 |
| 5,516,377 | | 5/1996 | Highsmith et al. | 149/18 |
| 5,529,647 | | 6/1996 | Taylor et al. | 149/2 |
| 5,531,941 | | 7/1996 | Poole | 264/3.4 |
| 5,542,998 | | 8/1996 | Bucerius et al. | 149/45 |
| 5,542,999 | | 8/1996 | Bucerius et al. | 149/45 |
| 5,545,272 | * | 8/1996 | Pook et al. | 149/48 |
| 5,682,014 | * | 10/1997 | Highsmith et al. | 149/36 |
| 5,756,929 | * | 5/1998 | Lundstrom et al. | 149/22 |
| 5,783,773 | * | 7/1998 | Poole | 149/36 |
| 5,866,842 | * | 2/1999 | Wilson et al. | 149/46 |
| 5,872,329 | * | 2/1999 | Burns et al. | 149/36 |
| 6,074,502 | * | 6/2000 | Burns et al. | 149/36 |
| 6,077,371 | * | 6/2000 | Lundstrom et al. | 149/37 |

* cited by examiner

*Primary Examiner*—Michael J. Carone
*Assistant Examiner*—Francis T. Palo
(74) *Attorney, Agent, or Firm*—Laurence C. Begin; Dinnin & Dunn PC

(57) ABSTRACT

Thermally stable gas generant compositions incorporate a combination of nitroguanidine, one or more nonazide high-nitrogen fuels, and phase-stabilized ammonium nitrate or a similar nonmetallic oxidizer that, upon combustion, result in a greater yield of gaseous products per mass unit of gas generant, a reduced yield of solid combustion products, and acceptable burn rates, thermal stability, and ballistic properties. These compositions are especially suitable for inflating air bags in passenger-restraint devices.

12 Claims, No Drawings

THERMALLY STABLE NONAZIDE AUTOMOTIVE AIRBAG PROPELLANTS

CROSS-REFERENCE TO RELATED APPLICATIONS

The present application is a continuation-in-part of U.S. patent application Ser. No. 08/681,662, filed on Jul. 29, 1996 now abandoned.

BACKGROUND OF THE INVENTION

1. Field of the Invention

The present invention relates to nontoxic gas generating compositions are described that upon combustion, rapidly generate gases that are useful for inflating occupant safety restraints in motor vehicles and specifically, the invention relates to thermally stable nonazide gas generants having not only acceptable burn rates, but that also, upon combustion, exhibit a relatively high gas volume to solid particulate ratio at acceptable flame temperatures.

The evolution from azide-based gas generants to nonazide gas generants is well-documented in the prior art. The advantages of nonazide gas generant compositions in comparison with azide gas generants have been extensively described in the patent literature, for example, U.S. Pat. Nos. 4,370,181; 4,909,549; 4,948,439; 5,084,118; 5,139,588 and 5,035,757, the discussions of which are hereby incorporated by reference.

In addition to a fuel constituent, pyrotechnic nonazide gas generants contain ingredients such as oxidizers to provide the required oxygen for rapid combustion and reduce the quantity of toxic gases generated, a catalyst to promote the conversion of toxic oxides of carbon and nitrogen to innocuous gases, and a slag forming constituent to cause the solid and liquid products formed during and immediately after combustion to agglomerate into filterable clinker-like particulates. Other optional additives, such as burning rate enhancers or ballistic modifiers and ignition aids, are used to control the ignitability and combustion properties of the gas generant.

One of the disadvantages of known nonazide gas generant compositions is the amount and physical nature of the solid residues formed during combustion. The solids produced as a result of combustion must be filtered and otherwise kept away from contact with the occupants of the vehicle. It is therefore highly desirable to develop compositions that produce a minimum of solid particulates while still providing adequate quantities of a nontoxic gas to inflate the safety device at a high rate.

The use of phase stabilized ammonium nitrate is desirable because it generates abundant nontoxic gases and minimal solids upon combustion. To be useful, however, gas generants for automotive applications must be thermally stable when aged for 400 hours or more at 107° C. The compositions must also retain structural integrity when cycled between −40° C. and 107° C.

Often, gas generant compositions incorporating phase stabilized or pure ammonium nitrate exhibit poor thermal stability, and produce unacceptably high levels of toxic gases, CO and $NO_x$ for example, depending on the composition of the associated additives such as plasticizers and binders. In addition, ammonium nitrate contributes to poor ignitability, lower burn rates, and performance variability. Several known gas generant compositions incorporating ammonium nitrate utilize well known ignition aids such as $BKNO_3$ to solve this problem. However, the addition of an ignition aid such as $BKNO_3$ is undesirable because it is a highly sensitive and energetic compound, and furthermore, contributes to thermal instability and an increase in the amount of solids produced.

Certain gas generant compositions comprised of ammonium nitrate are thermally stable, but have burn rates less than desirable for use in gas inflators. To be useful for passenger restraint inflator applications, gas generant compositions generally require a burn rate of at least 0.4 inch/second (ips) or more at 1000 psi. Gas generants with burn rates of less than 0.40 ips at 1000 psi do not ignite reliably and often result in "no-fires" in the inflator.

Yet another problem that must be addressed is that the U.S. Department of Transportation (DOT) regulations require "cap testing" for gas generants. Because of the sensitivity to detonation of fuels often used in conjunction with ammonium nitrate, most propellants incorporating ammonium nitrate do not pass the cap test unless shaped into large disks, which in turn reduces design flexibility of the inflator.

Accordingly, many nonazide propellants based on ammonium nitrate cannot meet requirements for automotive applications.

2. Description of the Related Art

A description of the related art follows, the complete teachings of which are herein incorporated by reference.

U.S. Pat. No. 5,545,272 to Poole discloses the use of gas generant compositions consisting of nitroguanidine (NQ), at a weight percent of 35%–55%, and phase stabilized ammonium nitrate (PSAN) at a weight percent of 45%–65%. NQ, as a fuel, is preferred because it generates abundant gases and yet consists of very little carbon or oxygen, both of which contribute to higher levels of CO and NOx in the combustion gases. According to Poole, the use of phase stabilized ammonium nitrate (PSAN) or pure ammonium nitrate is problematic because many gas generant compositions containing the oxidizer are thermally unstable. Poole has found that combining NQ and PSAN in the percentages given results in thermally stable gas generant compositions. However, Poole reports burn rates of only 0.32–0.34 inch per second, at 1000 psi. As is well known, burn rates below 0.4 inch per second at 1000 psi are simply too low for confident use within an inflator.

In U.S. Pat. No. 5,531,941 to Poole, Poole teaches the use of PSAN, and two or more fuels selected from a specified group of nonazide fuels. Poole adds that gas generants using ammonium nitrate (AN) as the oxidizer are generally very slow burning with burning rates at 1000 psi typically less than 0.1 inch per second. He further teaches that for air bag applications, burning rates of less than about 0.4 to 0.5 inch per second are difficult to use. The use of PSAN is taught as desirable because of its propensity to produce abundant gases and minimal solids, with minimal noxious gases. Nevertheless, Poole recognizes the problem of low burn rates and thus combines PSAN with a fuel component containing a majority of TAGN, and if desired one or more additional fuels. The addition of TAGN increases the burn rate of ammonium nitrate mixtures. According to Poole, TAGN/PSAN compositions exhibit acceptable burn rates of 0.59–0.83 inch/per second. TAGN, however, is a sensitive explosive that poses safety concerns in processing and handling. In addition, TAGN is classified as "forbidden" by the Department of Transportation, therefore complicating raw material requirements.

In U.S. Pat. No. 5,500,059 to Lund et al., Lund states that burn rates in excess of 0.5 inch per second (ips) at 1,000 psi, and preferably in the range of from about 1.0 ips to about 1.2 ips at 1,000 psi, are generally desired. Lund discloses gas generant compositions comprised of a 5aminotetrazole fuel and a metallic oxidizer component. The use of a metallic oxidizer reduces the amount of gas liberated per gram of gas generant, however, and increases the amount of solids generated upon combustion.

The gas generant compositions described in Poole et al, U.S. Pat. Nos. 4,909,549 and 4,948,439, use tetrazole or triazole compounds in combination with metal oxides and oxidizer compounds (alkali metal, alkaline earth metal, and pure ammonium nitrates or perchlorates) resulting in a relatively unstable generant that decomposes at low temperatures. Significant toxic emissions and particulate are formed upon combustion. Both patents teach the use of $BKNO_3$ as an ignition aid.

The gas generant compositions described in Poole, U.S. Pat. No. 5,035,757, result in more easily filterable solid products but the gas yield is unsatisfactory.

Chang et al, U.S. Pat. No. 3,954,528, describes the use of TAGN and a synthetic polymeric binder in combination with an oxidizing material. The oxidizing materials include pure AN although, the use of PSAN is not suggested. The patent teaches the preparation of propellants for use in guns or other devices where large amounts of carbon monoxide, nitrogen oxides, and hydrogen are acceptable and desirable. Because of the practical applications involved, thermal stability is not considered a critical parameter.

Grubaugh, U.S. Pat. No. 3,044,123, describes a method of preparing solid propellant pellets containing AN as the major component. The method requires use of an oxidizable organic binder (such as cellulose acetate, PVC, PVA, acrylonitrile and styrene-acrylonitrile), followed by compression molding the mixture to produce pellets and by heat treating the pellets. These pellets would certainly be damaged by temperature cycling because commercial ammonium nitrate is used, and the composition claimed would produce large amounts of carbon monoxide.

Becuwe, U.S. Pat. No. 5,034,072, is based on the use of 5-oxo-3-nitro-1,2,4-triazole as a replacement for other explosive materials (HMX, RDX, TATB, etc.) in propellants and gun powders. This compound is also called 3-nitro-1,2,4-triazole-5-one ("NTO"). The claims appear to cover a gun powder composition which includes NTO, AN and an inert binder, where the composition is less hygroscopic than a propellant containing ammonium nitrate. Although called inert, the binder would enter into the combustion reaction and produce carbon monoxide making it unsuitable for air bag inflation.

Lund et al, U.S. Pat. No. 5,197,758, describes gas generating compositions comprising a nonazide fuel which is a transition metal complex of an aminoarazole, and in particular are copper and zinc complexes of 5-aminotetrazole and 3-amino-1,2,4-triazole which are useful for inflating air bags in automotive restraint systems, but generate excess solids.

Wardle et al, U.S. Pat. No. 4,931,112, describes an automotive air bag gas generant formulation consisting essentially of NTO (5-nitro-1,2,4-triazole-3-one) and an oxidizer wherein said formulation is anhydrous.

Ramnarace, U.S. Pat. No. 4,111,728, describes gas generators for inflating life rafts and similar devices or that are useful as rocket propellants comprising ammonium nitrate, a polyester type binder and a fuel selected from oxamide and guanidine nitrate. Ramnarace teaches that ammonium nitrate contributes to burn rates lower than those of other oxidizers and further adds that ammonium nitrate compositions are hygroscopic and difficult to ignite, particularly if small amounts of moisture have been absorbed.

Bucerius et al, U.S. Pat. No. 5,198,046, teaches the use of diguanidinium-5,5'-azotetrazolate (GZT) with $KNO_3$ as an oxidizer, for use in generating environmentally friendly, non-toxic gases. Bucerius teaches away from combining GZT with any chemically unstable and/or hygroscopic oxidizer. The use of other amine salts of tetrazole such as bis-(triaminoguanidinium)-5,5'-azotetrazolate (TAGZT) or aminoguanidinium-5,5'-azotetrazolate are taught as being much less thermally stable when compared to GZT.

Boyars, U.S. Pat. No. 4,124,368, describes a method for preventing detonation of ammonium nitrate by using potassium nitrate.

Mishra, U.S. Pat. No. 4,552,736, and Mehrotra et al, U.S. Pat. No. 5,098,683, describe the use of potassium fluoride to eliminate expansion and contraction of ammonium nitrate in transition phase.

Chi, U.S. Pat. No. 5,074,938, describes the use of phase stabilized ammonium nitrate as an oxidizer in propellants containing boron and as useful in rocket motors.

In U.S. Patent 5,125,684 to Cartwright, an extrudable propellant for use in crash bags is described as comprising an oxidizer salt, a cellulose-based binder and a gas generating component. Cartwright also teaches the use of "at least one energetic component selected from nitroguanidine (NG), triaminoguanidine nitrate, ethylene dinitramine, cyclotrimethylenetrinitramine (RDX), cyclotetramethylenetetranitramine (HMX), trinitrotoluene (TNT), and pentaerythritol tetranitrate (PETN) . . . ."

In U.S. Pat. No. 4,925,503 to Canterbury et al, an explosive composition is described as comprising a high energy material, e.g., ammonium nitrate and a polyurethane polyacetal elastomer binder, the latter component being the focus of the invention. Canterbury also teaches the use of a "high energy material useful in the present invention . . . preferably one of the following high energy materials: RDX, NTO, TNT, HMX, TAGN, nitroguanidine, or ammonium nitrate . . . ."

Hass, U.S. Pat. No. 3,071,617, describes long known considerations as to oxygen balance and exhaust gases.

Stinecipher et al, U.S. Pat. No. 4,300,962, describes explosives comprising ammonium nitrate and an ammonium salt of a nitroazole.

Prior, U.S. Pat. No. 3,719,604, describes gas generating compositions comprising aminoguanidine salts of azotetrazole or of ditetrazole.

Poole, U.S. Pat. No. 5,139,588, describes nonazide gas generants useful in automotive restraint devices comprising a fuel, an oxidizer and additives.

Hendrickson, U.S. Pat. No. 4,798,637, teaches the use of bitetrazole compounds, such as diammonium salts of bitetrazole, to lower the burn rate of gas generant compositions. Hendrickson describes burn rates below 0.40 ips, and an 8% decrease in the burn rate when diammonium bitetrazole is used.

Chang et al, U.S. Pat. No. 3,909,322, teaches the use of nitroaminotetrazole salts with oxidizers such as pure ammonium nitrate, HMX, and 5-ATN. These compositions are used as gun propellants and gas generants for use in gas pressure actuated mechanical devices such as engines, electric generators, motors, turbines, pneumatic tools, and rockets. In contrast to the amine salts disclosed by Hendrickson, Chang teaches that gas generants comprised of 5-aminotetrazole nitrate and salts of nitroaminotetrazole exhibit burn rates in excess of 0.40 ips. On the other hand, Chang also teaches that gas generants comprised of HMX and salts of nitroaminotetrazole exhibit burn rates of 0.243 ips to 0.360 ips. No data is given with regard to burn rates associated with pure AN and salts of nitroaminotetrazole.

Highsmith et al, U.S. Pat. No. 5,516,377, teaches the use of a salt of 5-nitraminotetrazole, NQ, a conventional ignition aid such as $BKNO_3$, and pure ammonium nitrate as an oxidizer, but does not teach the use of phase stabilized ammonium nitrate. Highsmith states that a composition comprised of ammonium nitraminotetrazole and strontium nitrate exhibits a burn rate of 0.313 ips. This is to low for automotive application. As such, Highsmith emphasizes the use of metallic salts of nitraminotetrazole.

Onishi et al, U.S. Pat. No. 5,439,251, teaches the use of a tetrazole amine salt as an air bag gas generating agent comprising a cationic amine and an anionic tetrazolyl group having either an alkyl with carbon number 1–3, chlorine, hydroxyl, carboxyl, methoxy, aceto, nitro, or another tetrazolyl group substituted via diazo or triazo groups at the 5-position of the tetrazole ring. The inventive thrust is to improve the physical properties of tetrazoles with regard to impact and friction sensitivity, and therefore does not teach the combination of an amine or nonmetal tetrazole salt with any other chemical.

Lund et al, U.S. Pat. No. 5,501,823, teaches the use of nonazide anhydrous tetrazoles, derivatives, salts, complexes, and mixtures thereof, for use in air bag inflators. The use of bitetrazole-amines, not amine salts of bitetrazoles, is also taught.

Based on the above, the need remains for a PSAN-based gas generant which is thermally stable at 107C, ignites readily and without delay, has a burn rate at 1000 psi of greater than 0.40–0.50 ips, and contains no sensitive explosive compounds.

SUMMARY OF THE INVENTION

The aforementioned problems are solved by a nonazide gas generant for a vehicle passenger restraint system comprising phase stabilized ammonium nitrate, nitroguanidine, and one or more nonazide fuels. The nonazide fuels are selected from a group including guanidines; tetrazoles such as 5,5'bitetrazole, diammonium bitetrazole, diguanidinium-5,5'-azotetrazolate (GZT), and nitrotetrazoles such as 5-nitrotetrazole; triazoles such as nitroaminotriazole, nitrotriazoles, and 3-nitro-1,2,4 triazole-5-one; and salts of tetrazoles and triazoles.

A preferred fuel(s) is selected from the group consisting of amine and other nonmetal salts of tetrazoles and triazoles having a nitrogen containing cationic component and a tetrazole and/or triazole anionic component. The anionic component comprises a tetrazole or triazole ring, and an R group substituted on the 5-position of the tetrazole ring, or two R groups substituted on the 3- and 5-positions of the triazole ring. The R group(s) is selected from hydrogen and any nitrogen-containing compounds such as amino, nitro, nitramino, tetrazolyl and triazolyl groups. The cationic component is formed from a member of a group including amines, aminos, and amides including ammonia, hydrazine, guanidine compounds such as guanidine, aminoguanidine, diaminoguanidine, triaminoguanidine, dicyandiamide, nitroguanidine, nitrogen subsituted carbonyl compounds such as urea, carbohydrazide, oxamide, oxamic hydrazide, bis-(carbonamide) amine, azodicarbonamide, and hydrazodicarbonamide, and, amino azoles such as3-amino-1,2,4-triazole, 3-amino-5-nitro-1,2,4-triazole, 5-aminotetrazole and 5-nitraminotetrazole. Optional inert additives such as clay, alumina, or silica may be used as a binder, slag former, coolant or processing aid. Optional ignition aids comprised of nonazide propellants may also be utilized in place of conventional ignition aids such as $BKNO_3$.

DETAILED DESCRIPTION OF THE PREFERRED EMBODIMENT(S)

A nonazide gas generant comprises phase stabilized ammonium nitrate (PSAN), nitroguanidine (NQ), and one or more nonazide high-nitrogen fuels. One or more high-nitrogen fuels are selected from a group including tetrazoles such as 5-nitrotetrazole, 5,5'-bitetrazole, triazoles such as nitroaminotriazole, nitrotriazoles, nitrotetrazoles, salts of tetrazoles and triazoles, and 3-nitro-1,2,4 triazole-5-one.

More specifically, salts of tetrazoles include in particular, amine, amino, and amide salts of tetrazole and triazole selected from the group including monoguanidinium salt of 5,5'-Bis-1H-tetrazole (BHT.1GAD), diguanidinium salt of 5,5'-Bis-1H-tetrazole (BHT.2GAD), monoaminoguanidinium salt of 5,5'-Bis-1H-tetrazole (BHT.1AGAD), diaminoguanidinium salt of 5,5'-Bis-1H-tetrazole (BHT.2AGAD), monohydrazinium salt of 5,5'-Bis-1H-tetrazole (BHT.1HH), dihydrazinium salt of 5,5'-Bis-1H-tetrazole (BHT.2HH), monoammonium salt of 5,5'-bis-1H-tetrazole ($BHT.1NH_3$), diammonium salt of 5,5'-bis-1H-tetrazole ($BHT.2NH_3$), mono-3-amino-1,2,4-triazolium salt of 5,5'-bis-1H-tetrazole (BHT.1ATAZ), di-3-amino-1,2,4-triazolium salt of 5,5'-bis-1H-tetrazole (BHT.2ATAZ), and diguanidinium salt of 5,5'-Azobis-1H-tetrazole (ABHT.2GAD).

Amine salts of triazoles include monoammonium salt of 3-nitro-1,2,4-triazole ($NTA.1NH_3$), monoguanidinium salt of 3-nitro-1,2,4-triazole (NTA.1GAD), diammonium salt of dinitrobitriazole ($DNBTR.2NH_3$), diguanidinium salt of dinitrobitriazole (DNBTR.2GAD), and monoammonium salt of 3,5-dinitro-1,2,4-triazole ($DNTR.1NH_3$).

Formula I

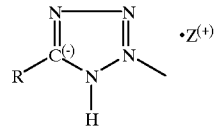

Formula II

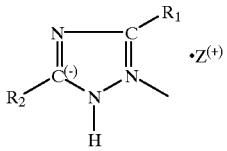

A generic nonmetal salt of tetrazole as shown in Formula I includes a cationic nitrogen containing component, Z, and an anionic component comprising a tetrazole ring and an R group substituted on the 5-position of the tetrazole ring. A generic nonmetal salt of triazole as shown in Formula II includes a cationic nitrogen containing component, Z, and an anionic component comprising a triazole ring and two R groups substituted on the 3- and 5-positions of the triazole ring, wherein R, may or may not be structurally synonymous with $R_2$. An R component is selected from a group including hydrogen or any nitrogen-containing compound such as an amino, nitro, nitramino, or a tetrazolyl or triazolyl group as shown in Formula I or II, respectively, substituted directly or via amine, diazo, or triazo groups. The compound Z is substituted at the 1-position of either formula, and is formed from a member of the group comprising amines, aminos, and amides including ammonia, carbohydrazide, oxamic hydrazide, and hydrazine; guanidine compounds such as guanidine, aminoguanidine, diaminoguanidine, triaminoguanidine, dicyandiamide and nitroguanidine; nitrogen substituted carbonyl compounds or amides such as urea, oxamide, bis-(carbonamide) amine, azodicarbonamide, and hydrazodicarbonamide; and, amino azoles such as 3-amino-1,2,4-triazole, 3-amino-5-nitro-1,2,4-triazole, 5-aminotetrazole, 3-nitramino-1,2,4-triazole, 5-nitraminotetrazole, and melamine.

Certain gas generant compositions of the present invention contain a hydrated or anhydrous mixture of nitroguanidine, at least one nonazide high-nitrogen fuels selected from the group consisting of guanidines, tetrazoles, triazoles, salts of tetrazole, and salts of triazole, and an oxidizer selected from the group consisting of phase stabilized ammonium nitrate and ammonium perchlorate. The nonazide fuels may be further selected from the group consisting of 1-, 3-, and 5-substituted nonmetal salts of triazoles, and 1- and 5-substituted nonmetal salts of tetrazoles wherein the salts consist of nonmetallic cationic and anionic components, and, the salts are substituted with hydrogen or a nitrogen-containing compound.

In accordance with the present invention, a preferred gas generant composition results from the mixture of gas generant constituents including nitroguanidine, comprising 1%–30% by weight of the gas generant composition, one or more amine salts of tetrazoles and/or triazoles, comprising 4%–40% by weight of the gas generant composition, and PSAN, comprising 40%–85% by weight of the gas generant composition. In the percentages given, an even more preferred embodiment results from the mixture of gas generant constituents consisting essentially of NQ, PSAN, and amine salt(s) of 5,5'-bis-1H-tetrazole. In the percentages given, a most preferred composition results from the mixture of gas generant constituents consisting essentially of NQ, PSAN, and diammonium salt of 5,5'-bis-1H-tetrazole ($BHT.2NH_3$). When combined, the fuel component consisting of NQ and one or more high nitrogen fuels as described herein, comprises 15%–60% by weight of the gas generant composition.

In accordance with procedures well known in the art, the foregoing nonazide fuels, are blended with an oxidizer such as PSAN, and NQ. The manner and order in which the components of the gas generant compositions of the present invention are combined and compounded is not critical so long as the proper particle size of ingredients are selected to ensure the desired mixture is obtained. The compounding is performed by one skilled in the art, under proper safety procedures for the preparation of energetic materials, and under conditions which will not cause undue hazards in processing nor decomposition of the components employed. For example, the materials may be wet blended, or dry blended and attrited in a ball mill or Red Devil type paint shaker and then pelletized by compression molding. The materials may also be ground separately or together in a fluid energy mill, sweco vibroenergy mill or bantam micropulverizer and then blended or further blended in a v-blender prior to compaction.

Compositions having components more sensitive to friction, impact, and electrostatic discharge should be wet ground separately followed by drying. The resulting fine powder of each of the components may then be wet blended by tumbling with ceramic cylinders in a ball mill jar, for example, and then dried. Less sensitive components may be dry ground and dry blended at the same time.

Phase stabilized ammonium nitrate is prepared as taught in co-owned U.S. Pat. No. 5,531,941 entitled, "Process For Preparing Azide-free Gas Generant Composition". Other nonmetal inorganic oxidizers such as ammonium perchlorate, or oxidizers that produce minimal solids when combined and combusted with the fuels listed above, may also be used. The ratio of oxidizer to fuel is preferably adjusted so that the amount of oxygen allowed in the equilibrium exhaust gases is less than 3% by weight, and more preferably less than or equal to 2% by weight. The oxidizer comprises 40%–85% by weight of the gas generant composition.

The gas generant constituents of the present invention are commercially available. For example, the amine salts of tetrazoles may be purchased from Toyo Kasei Kogyo Company Limited, Japan. Nitroguanidine may be purchased from Nigu Chemie, and, the components used to synthesize PSAN, as described herein, may be purchased from Fisher or Aldrich. Triazole salts may be synthesized by techniques, such as those described in U.S. Pat. No. 4,236,014 to Lee et al.; in "New Explosives: Nitrotriazoles Synthesis and Explosive Properties", by H.H. Licht, H. Ritter, and B. Wanders, Postfach 1260, D-79574 Weil am Rhein; and in "Synthesis of Nitro Derivatives of Triazoles", by Ou Yuxiang, Chen Boren, Li Jiarong, Dong Shuan, Li Jianjun, and Jia Huiping, *Heterocycles*, Vol. 38, No. 7, pps. 1651–1664, 1994. The teachings of these references are herein incorporated by reference. Other compounds in accordance with the present invention may be obtained as taught in the references incorporated herein, or from other sources well known to those skilled in the art.

An optional burn rate modifier, from 0–10% by weight in the gas generant composition, is selected from a group including an alkali metal, an alkaline earth or a transition metal salt of tetrazoles or triazoles; an alkali metal or alkaline earth nitrate or nitrite; TAGN; dicyandiamide, and alkali and alkaline earth metal salts of dicyandiamide; alkali and alkaline earth borohydrides; or mixtures thereof. An optional combination slag former and coolant, in a range of 0 to 10% by weight, is selected from a group including clay, silica, glass, and alumina, or mixtures thereof. When combining the optional additives described, or others known to those skilled in the art, care should be taken to tailor the additions with respect to acceptable thermal stability, burn rates, and ballistic properties.

In accordance with the present invention, the combination of NQ, PSAN, and one or more nonazide high-nitrogen fuels, as determined by gravimetric procedures, yields beneficial gaseous products equal to or greater than 90% of the total product mass, and solid products equal to or lesser than 10% of the total product mass. Fuels suitable in practicing the present invention are high in nitrogen content and low in carbon content thereby providing a high burn rate and a minimal generation of carbon monoxide.

The synergistic effect of the high-nitrogen fuels, in combination with an oxidizer producing minimal solids when combined with the fuels, results in several long-awaited benefits. Increased gas production per mass unit of gas generant results in the use of a smaller chemical charge. Reduced solids production results in minimized filtration needs and therefore a smaller filter. Together, the smaller charge and smaller filter thereby facilitate a smaller gas inflator system. Furthermore, the gas generant compositions of the present invention have burn rates and ignitability that meet and surpass performance criteria for use within a passenger restraint system, thereby reducing performance variability.

As shown in Example 10, it has also been found that the use of nitroguanidine functions to retard the volumetric phase changes normally exhibited by pure ammonium nitrate, thereby further stabilizing the PSAN.

An unexpected benefit of the present chemical compositions is thermal stability. The thermal stability of the gas generants is unexpected based on the poor stability of other fuels and in particular, triazoles and tetrazoles, when combined with PSAN. In contrast to other thermally stable compositions consisting of NQ and PSAN, these compositions ignite readily and without delay and have a burn rate greater than 0.40–0.50 ips at 1000 psi. Furthermore, the amine salts of tetrazoles and triazoles are neither explosive nor flammable and can be transported as non-hazardous chemicals.

The present invention is illustrated by the following examples. All compositions are given in percent by weight.

EXAMPLE 1

Comparative Example

A mixture of ammonium nitrate (AN), potassium nitrate (KN), and guanidine nitrate (GN) was prepared having 45.35% $NH_4NO_3$, 8.0% KN, and 46.65% GN. The ammonium nitrate was phase stabilized by coprecipitating with KN.

The mixture was dry-blended and ground in a ball mill. Thereafter, the dry-blended mixture was compression-molded into pellets. The burn rate of the composition was determined by measuring the time required to burn a cylindrical pellet of known length at constant pressure. The burn rate at 1000 pounds per square inch (psi) was 0.257 inches per second (in/sec); the burn rate at 1500 psi was 0.342 in/sec. The corresponding pressure exponent was 0.702.

EXAMPLE 2

Comparative Example

A mixture of 46.13% $NH_4NO_3$, 8.14% KN, 35.73% GN, and 10.0% nitroguanidine (NQ) was prepared and tested as described in Example 1. The burn rate at 1000 psi was 0.282 in/sec and the burn rate at 1500 psi was 0.368 in/sec. The corresponding pressure exponent was 0.657.

EXAMPLE 3

Comparative Example

A mixture of 46.91% $NH_4NO_3$, 8.28% KN, 24.81% GN, and 20.0% NQ was prepared and tested as described in Example 1. The burn rate at 1000 psi was 0.282 in/sec and the burn rate at 1500 psi was 0.373 in/sec. The corresponding pressure exponent was 0.680.

EXAMPLE 4

Comparative Example

A mixture of 52.20% $NH_4NO_3$, 9.21% KN, 28.59% GN, and 10.0% 5-aminotetrazole (5AT) was prepared and tested as described in Example 1. The burn rate at 1000 psi was 0.391 in/sec and the burn rate at 1500 psi was 0.515 in/sec. The corresponding pressure exponent was 0.677.

EXAMPLE 5

Comparative Example

Table 1 illustrates the problem of thermal instability when typical nonazide fuels are combined with PSAN:

TABLE 1

Thermal Stability of PSAN - Non-Azide Fuel Mixtures

| Non-Azide Fuel(s) Combined with PSAN | Thermal Stability |
|---|---|
| 5-aminotetrazole (5AT) | Melts with 108 C. onset and 116 C. peak. Decomposed with 6.74% weight loss when aged at 107 C. for 336 hours. Poole '272 shows melting with loss of $NH_3$ when aged at 107 C. |
| ethylene diamine dinitrate, nitroguanidine (NQ) | Poole '272 shows melting at less than 100 C. |
| 5AT, NQ | Melts with 103 C. onset and 110 C. peak. |
| 5AT, NQ quanidine nitrate (GN) | Melts with 93 C. onset on 99 C. peak. |
| GN, NQ | Melts with 100 C. onset and 112 C. Decomposed with 6.49% weight loss when aged at 107 C. for 336 hours. |
| GN, 3-nitro-1,2,4-triazole (NTA) | Melts with 108 C. onset and 110 C. peak. |
| NQ, NTA | Melts with 111 C. onset and 113 C. peak. |
| aminoguanidine nitrate | Melts with 109 C. onset and 110 C. peak. |
| 1H-tetrazole (1HT) | Melts with 109 C. onset and 110 C. peak. |
| dicyandiamide (DCDA) | Melts with 114 C. onset and 114 C. peak. |
| GN, DCDA | Melts with 104 C. onset and 105 C. peak. |
| NQ, DCDA | Melts with 107 C. onset and 115 C. peak. Decomposed with 5.66% weight loss when aged at 107 C. for 336 hours. |
| 5AT, GN | Melts with 70 C. onset and 99 C. peak. |
| magnesium salt of 5AT (M5AT) | Melts with 100 C. onset and 111 C. peak. |

In this example, "decomposed" indicates that pellets of the given formulation were discolored, expanded, fractured, and/or stuck together (indicating melting), making them unsuitable for use in an air bag inflator. In general, any PSAN-nonazide fuel mixture with a melting point of less than 115C will decompose when aged at 107C. As shown, many compositions that comprise well known nonazide fuels and PSAN are not fit for use within an inflator due to poor thermal stability.

EXAMPLE 6

Comparative Example

A mixture of 56.30% $NH_4NO_3$, 9.94% KN, 17.76% GN, and 16.0% 5AT was prepared and tested as described in Example 1. The burn rate at 1000 psi was 0.473 in/sec and the burn rate at 1500 psi was 0.584 in/sec. The corresponding pressure exponent was 0.518. The burn rate is acceptable, however, compositions containing GN, 5-AT, and PSAN are not thermally stable as shown in Table 1, EXAMPLE 5.

EXAMPLE 7

TABLE 2

Gas Generating Characteristics of GZT, NQ, and PSAN.

| | | | | | | |
|---|---|---|---|---|---|---|
| PSAN (wt %) | 78.22 | 75.83 | 73.45 | 71.06 | 68.68 | 66.29 |
| GZT (wt %) | 21.78 | 19.17 | 16.55 | 13.94 | 11.32 | 8.71 |
| NQ (wt %) | 0.00 | 5.00 | 10.00 | 15.00 | 20.00 | 25.00 |
| Gas Conversion (wt %) | 96.36 | 96.47 | 69.58 | 96.69 | 96.80 | 96.91 |
| Gas Yield (mol/100 g GG) | 4.06 | 4.05 | 4.04 | 4.04 | 4.03 | 4.02 |
| Gaseous $N_2$ | 37.8 | 37.7 | 37.6 | 37.5 | 37.5 | 37.4 |

TABLE 2-continued

| Gas Generating Characteristics of GZT, NQ, and PSAN. | | | | | | |
|---|---|---|---|---|---|---|
| Products $CO_2$ (vol. %) $H_2O$ | 7.6 54.7 | 7.9 54.5 | 8.1 54.3 | 8.4 54.0 | 8.7 53.8 | 9.0 53.6 |
| Solid Products $K_2O$ (g/100 g GG) | 3.64 | 3.53 | 3.42 | 3.31 | 3.20 | 3.09 |
| Flame Temperature (K.) | 2254 | 2275 | 2296 | 2317 | 2337 | 2358 |

As shown in table 2, gas generant compositions consisting essentially of GZT, NQ, and PSAN generate mostly gas and minimal solids when combusted.

EXAMPLE 8

TABLE 3a

| Gas generants comprising BHT-2NH$_3$ or GZT, and PSAN. | | | | | |
|---|---|---|---|---|---|
| PSAN 10% KN (WT %) | | | | | 74.25 |
| PSAN 15% KN (wt %) | 76.43 | 75.40 | 72.32 | 75.60 | |
| BHT-2NH$_3$ (wt %) | 23.57 | 24.60 | 27.68 | | |
| BHT-2GAD (wt %) | | | | 24.40 | |
| GZT (wt %) | | | | | 25.75 |
| NQ (wt %) | | | | | |
| Gas Yield | 95 | 95 | 95 | 95 | 97 |
| Melting Point (C.) | 158 | 159 | 159 | 131 | 125 |
| Aging at 107 C. | No Deco. | No Deco. | No Deco. | No Deco. | No Deco. |
| Ignitability | Exc. | Exc. | Exc. | Exc. | Exc. |
| Tailorability of Ballistic Properties | Marg. | Marg. | Marg. | Marg. | Marg. |
| Flame Temperature | 2179 | 2156 | 2074 | 2052 | 2166 |
| Rb1000 (ips) | 0.48 | 0.47 | 0.52 | 0.57 | 0.51 |

TABLE 3b

| Gas generants comprising BHT-2NH$_3$, PSAN, and NQ. | | | | | | | |
|---|---|---|---|---|---|---|---|
| PSAN 10% KN (wt %) | 64.40 | 70.28 | 67.17 | 65.23 | 68.08 | 64.05 | 71.83 |
| PSAN 15% KN (wt %) | | | | | | | |
| BHT-2NH$_3$ (wt %) | 9.60 | 16.72 | 19.83 | 19.77 | 20.92 | 22.95 | 23.17 |
| BHT-2GAD (wt %) | | | | | | | |
| GZT (wt %) | | | | | | | |
| NQ (wt %) | 26.00 | 13.00 | 13.00 | 15.00 | 11.00 | 13.00 | 5.00 |
| Gas Yield (wt %) | 97 | 97 | 97 | 97 | 97 | 97 | 97 |
| Melting Point (C.) | 131 | 132 | 131 | 131 | 131 | 131 | 131 |
| Aging at 107C. | No Deco. | No Deco. | No Deco. | No Deco. | No Deco. | No Deco. | No Deco. |
| Ignitability | Marg. | Exc. | Exc. | Exc. | Exc. | Exc. | Exc. |
| Tailorability of Ballistic Propert. | Exc. | Exc. | Exc. | Exc. | Exc. | Exc. | Exc. |
| Flame Temp. (° C.) | 2346 | 2274 | 2186 | 2167 | 2174 | 2093 | 2170 |
| Rb1000 (ips) | 0.43 | 0.49 | 0.52 | 0.49 | 0.54 | 0.52 | 0.54 |

Table Reference:
No Deco. = No Decomposition
Exc. = Excellent
Marg. = Marginal

Applicants have found that it is difficult to tailor the ballistic performance of inflators containing gas generants consisting of PSAN and an amine or amide salt(s) of tetrazole or triazole. Applicants have also discovered that in addition to excellent burn rates and ignitability, the addition of nitroguanidine to these compositions facilitates simplified tailorability of ballistic performance, thereby making inflator design much simpler. As shown in Tables 3a and 3b, the ballistic tailorability of compositions comprised of PSAN and amine salts of tetrazoles is substantially improved by the addition of NQ. Example 9 further illustrates this.

When formulating these compositions, it was unexpected that with the addition of nitroguanidine, the mixture would still be thermally stable at 107C, and experience essentially no decrease in ignitability or burn rate.

EXAMPLE 9

Table 4 graphically illustrates the desirability of maintaining NQ in percentages below 35%, and more preferably below 26%. Five curves illustrate the effect of increasing the percentage of NQ from 0–26 weight percent. Table 4 lists data corresponding to each curve, wherein NQ is combined with BHT2NH$_3$. These compositions were pressed into pellets, loaded into an airbag inflator, and fired in a 60 L tank. In each of the following tests, all variables (pellet size, inflator configuration, etc.) were held constant, except for the formulation. Table 4 reflects testing that showed no significant change in any of the other desirable properties such as high gas yield, low solids, thermal stability, and burn rate.

TABLE 4

Ballistic Tailorability

| Curve | NQ (wt %) | BHT-2NH$_3$ + PSAN (wt %) | Time to 1 kPa (ms) | Maximum Slope (kPa/ms) | Peak Tank P (kPa) |
|---|---|---|---|---|---|
| 1 | 0 | 100 | 5.7 | 20.2 | 203.5 |
| 2 | 11 | 89 | 3.4 | 15.5 | 193.0 |
| 3 | 13 | 87 | 5.3 | 13.0 | 187.5 |
| 4 | 15 | 85 | 4.2 | 11.3 | 176.5 |
| 5 | 26 | 74 | 12.2 | 6.9 | 68.2 |

The time to a tank pressure of 1 kPa (known as time to first gas in the industry), the maximum slope, and the peak tank pressure are all used to describe the ballistic performance of an airbag inflator. It can be seen that as the amount of NQ in the composition increases, both the maximum slope and the peak tank pressure decrease. The time to first gas is at an acceptable level of 3 ms to 6 ms in curves 1–4. The time to first gas in curve 5 is at an undesirable high level, and is indicative of a delay in ignition of the gas generant. This demonstrates the poor ignitability of gas generant compositions containing higher percentages of NQ. The ignition delay seen in curve 5 can be corrected by operating at a higher inflator internal combustion pressure. However, this would result in the need for a much more robust inflator structure thereby increasing the size and weight of the inflator.

EXAMPLE 10

Another unexpected result is that nitroguanidine appears to help stabilize ammonium nitrate against volumetric phase changes during thermal cycling. A composition containing 49% AN, 9% KN, and 43% NQ was prepared by grinding and blending the dry materials together. The AN in this composition was unstabilized since the AN and KN were not combined to form a solution. This composition was tested by DSC and compared to pure AN. At room temperature, AN phase IV exists. Upon heating phase IV changes into phase II at about 55° C. This is clearly seen on the DSC for pure AN. For the composition containing AN and NQ, the phase change has been eliminated and does not occur below 110° C. It is believed that lower amounts of NQ will provide the same benefit of AN phase-stabilization.

EXAMPLE 11

A composition resulting from the mixture of gas generant constituents consisting of 70.28% PSAN, 16.72% BHT-$2NH_3$, and 13.00% NQ was prepared and pressed into pellets. The pellets were placed in a covered, but unsealed container in a helium-purged chamber and aged at 107° C. In this way, any volatiles formed during decomposition would result in a weight loss in the sample. After 408 hours of aging, the volatiles weight loss was 0.30%. After 2257 hours of aging, the volatiles weight loss was 0.97%. After aging, the pellets showed no physical signs of decomposition. In addition, thermal analysis (DSC) showed no significant differences in the pellets before and after aging. The pellets which were aged for 2257 hours at 107° C. were tested in an inflator and showed no significant differences in ballistic performance when compared to unaged pellets.

EXAMPLE 12

A composition resulting from the mixture of gas generant constituents consisting of 67.17% PSAN, 19.83% BHT-$2NH_3$, and 13.00% NQ was prepared and pressed into pellets. The PSAN was a co-crystallized mixture of 90% AN and 10% KN. The pellets were placed in sealed inflators and temperature cycled. One cycle consisted of holding the inflators at 105° C. for two hours, cooling to −40° C. in two hours, holding for two hours, and heating to 105° C. in two hours. After 50 cycles, the inflators were tested and showed no significant difference from the baseline units in ballistic performance. The physical appearance of the pellets after cycling was unchanged; there were no expansion or cracks as is normally seen in unstabilized AN.

Although the components of the present invention have been described in their anhydrous form, it will be understood that the teachings herein encompass the hydrated forms as well.

While the foregoing examples illustrate and describe the use of the present invention, they are not intended to limit the invention as disclosed in certain preferred embodiments herein. Therefore, variations and modifications commensurate with the above teachings and the skill and/or knowledge of the relevant art, are within the scope of the present invention.

We claim:

1. A gas generant composition consisting of a hydrated or anhydrous mixture of:

nitroguanidine and at least one nonazide high-nitrogen fuel selected from the group consisting of guanidines, tetrazoles, triazoles, salts of tetrazoles, and salts of triazoles; and phase stabilized ammonium nitrate as an oxidizer, wherein said composition has a melting point of at least 115° C., the ammonium nitrate is phase stabilized by coprecipitating with potassium nitrate, said nitroguanidine comprises 1%–26% by weight of said mixture; said at least one nonazide high-nitrogen fuel comprises 4%–40% by weight of said mixture, said nitroguanidine in combination with said at least one nonazide high nitrogen fuel comprises 15%–60% by weight of said mixture, and, said phase stabilized ammonium nitrate comprises 40%–85% by weight of said mixture.

2. A gas generant composition as claimed in claim 1 further comprising:

a burn rate modifier selected from the group consisting of alkali and alkaline earth metal nitrates and nitrites, dicyandiamide, alkali and alkaline earth metal salts of dicyandiamide, alkali and alkaline earth borohydrides, and mixtures thereof, wherein said bum rate modifier comprises not more than 10% by weight of said mixture.

3. A gas generant composition as claimed in claim 1 further comprising:

a combination slag former and coolant selected from the group consisting of clay, silica, glass, alumina, and mixtures thereof.

4. The composition of claim 1 wherein said at least one nonazide high nitrogen fuel is selected from the group consisting of 5-nitrotetrazole, 5,5'-bitetrazole, nitroaminotriazole, and 3-nitro-1,2,4 triazole-5-one.

5. A gas generant composition consisting of a hydrated or anhydrous mixture of:

nitroguanidine and at least one nonazide high-nitrogen fuel selected from the group consisting of monoguanidinium salt of 5,5'-Bis-1H-tetrazole, diguanidinium salt of 5,5'-Bis-1H-tetrazole, monoaminoguanidinium salt of 5,5'-Bis-1H-tetrazole, diaminoguanidinium salt of 5,5'-Bis-1H-tetrazole, monohydrazinium salt of 5,5'-Bis-1H-tetrazole, dihydrazinium salt of 5,5'-Bis-1H-tetrazole, monoammonium salt of 5,5'-bis-1H-tetrazole, diammonium salt of 5,5'-bis-1H-tetrazole, mono-3-amino-1,2,4-triazolium salt of 5,5'-bis-1H-tetrazole, di-3-amino-1,2,4-triazolium salt of 5,5'-bis-1H-tetrazole, diguanidinium-5,5'-azotetrazolate, monoammonium salt of 3-nitro-1,2,4-triazole, monoguanidinium salt of 3-nitro-1,2,4-triazole, diammonium salt of dinitrobitriazole, diguanidinium salt of dinitrobitriazole, and monoammonium salt of 3,5-dinitro-1,2,4-triazole; and phase stabilized ammonium nitrate as an oxidizer, wherein the ammonium nitrate is phase stabilized by coprecipitating with potassium nitrate, said nitroguanidine comprises 1%–26% by weight of said mixture, said at least one nonazide high-nitrogen fuel comprises 4%–40% by weight of said mixture, said nitroguanidine in combination with said at least one nonazide high nitrogen fuel comprises 15%–60% by weight of said mixture, and, said phase stabilized ammonium nitrate comprises 40%–85% by weight of said mixture.

6. A gas generant composition consisting of a hydrated or anhydrous mixture of:

nitroguanidine and at least one nonazide high-nitrogen fuel selected from the group consisting of nonmetal salts of triazoles substituted at the 1-, 3-, and 5-positions, and nonmetal salts of tetrazoles substituted at the 1- and 5-positions, said salts substituted at each position with a nitrogen-containing group; and phase stabilized ammonium nitrate as an oxidizer, wherein the ammonium nitrate is phase stabilized by coprecipitating with potassium nitrate, said nitroguanidine comprises 1%–26% by weight of said mixtures said at least one nonazide high-nitrogen fuel comprises 4%–40% by weight of said mixture, said nitroguanidine in combination with said at least one nonazide high nitrogen fuel comprises 15%–60% by weight of said mixture, and, said phase stabilized ammonium nitrate comprises 40–85% by weight of said mixture.

7. A gas generant composition consisting of a hydrated or anhydrous mixture of:

nitroguanidine and at least one nonazide high-nitrogen fuel selected from the group consisting of 1-, 3-, 5-substituted nonmetal salts of triazoles, and 1-, 5- substituted nonmetal salts of tetrazoles, said salts substituted at each position with a nitrogen-containing compound; and phase stabilized ammonium nitrate as an oxidizer, wherein the ammonium nitrate is phase stabilized by coprecipitating with potassium nitrate, said nitroguanidine comprises 1%–26% by weight of said mixture; said at least one nonazide high-nitrogen fuel comprises 4%–40% by weight of said mixture, said nitroguanidine in combination with said at least one nonazide high nitrogen fuel comprises 15%–60% by weight of said mixture, said phase stabilized ammonium nitrate comprises 40–85% by weight of said mixture.

8. A gas generant composition consisting of a hydrated or anhydrous mixture of:

nitroguanidine and at least one nonazide high-nitrogen fuel selected from the group consisting of guanidines, tetrazoles, triazoles, salts of tetrazoles, and salts of triazoles;

phase stabilized ammonium nitrate as an oxidizer, a burn rate modifier selected from the group consisting of alkali, alkaline earth, and transitional metal salts of tetrazole and triazole, triaminoguanidine nitrate, dicyandiamide, alkali and alkaline earth metal salts of dicyandiamide; alkali and alkaline earth borohydrides, and mixtures thereof; and a coolant selected from the group consisting of clay, silica, glass, and alumina, and mixtures thereof;

wherein said composition has a melting point of at least 115° C., the ammonium nitrate is phase stabilized by coprecipitating with potassium nitrate, said nitroguanidine comprises 1%–26% by weight of said mixture; said at least one nonazide high-nitrogen fuel comprises 4%–40% by weight of said mixture, said nitroguanidine in combination with said at least one nonazide high nitrogen fuel comprises 15%–60% by weight of said mixture, said phase stabilized ammonium nitrate comprises 40–85% by weight of said mixture, said burn rate modifier comprises 0–10% by weight of said mixture, and said coolant comprises 0–10% by weight of said mixture.

9. A gas generant composition consisting of a hydrated or anhydrous mixture of:

nitroguanidine and at least one nonazide high-nitrogen fuel selected from the group consisting of monoguanidinium salt of 5,5'-Bis-1H-tetrazole, diguanidinium salt of 5,5'-Bis-1-tetrazole, monoaminoguanidinium salt of 5,5'-Bis-1H-tetrazole, diaminoguanidinium salt of 5,5'-Bis-1H-tetrazole, monohydrazinium salt of 5,5'-Bis-1H-tetrazole, dihydrazinium salt of 5,5'-Bis-1-tetrazole, monoammonium salt of 5,5'-bis-1H-tetrazole, diammonium salt of 5,5'-bis-1H-tetrazole, mono-3-amino-1,2,4-triazolium salt of 5,5'-bis-1H-tetrazole, di-3-arnino-1,2,4-triazolium salt of 5,5'-bis-1H-tetrazole, diguanidinium-5,5'-azotetrazolate, monoammonium salt of 3-nitro-1,2,4-triazole, monoguanidinium salt of 3-nitro-1,2,4-triazole, diammonium salt of dinitrobitriazole, diguanidinium salt of dinitrobitriazole, and monoammonium salt of 3,5-dinitro- 1,2,4-triazole;

phase stabilized ammonium nitrate as an oxidizer, a burn rate modifier selected from the group consisting of alkali, alkaline earth, and transitional metal salts of tetrazole and triazole, triaminoguanidine nitrate, dicyandiamide, alkali and alkaline earth metal salts of dicyandiamide; alkali and alkaline earth borohydrides, and mixtures thereof; and a coolant selected from the group consisting of clay, silica, glass, and alumina, and mixtures thereof;

wherein the ammonium nitrate is phase stabilized by coprecipitating with potassium nitrate, said nitroguanidine comprises 1%–26% by weight of said mixture, said at least one nonazide high-nitrogen fuel comprises 4%–40% by weight of said mixture, said nitroguanidine in combination with said at least one nonazide high nitrogen fuel comprises 15%–60% by weight of said mixture, said phase stabilized ammonium nitrate comprises 40%–85% by weight of said mixture, said burn rate modifier comprises 0–10% by weight of said mixture, and said coolant comprises 0–10% by weight of said mixture.

10. A gas generant composition consisting of a hydrated or anhydrous mixture of: nitroguanidine and at least one nonazide high-nitrogen fuel selected from the group consisting of nonmetal salts of triazoles substituted at the 1-, 3-, and 5-positions, and nonmetal salts of tetrazoles substituted at the 1- and 5-positions, said salts substituted at each position with a nitrogen-containing group;

phase stabilized ammonium nitrate as an oxidizer, a bum rate modifier selected from the group consisting of alkali, alkaline earth, and transitional metal salts of tetrazole and triazole, triaminoguanidine nitrate, dicyandiamide, alkali and alkaline earth metal salts of dicyandiamide; alkali and alkaline earth borohydrides, and mixtures thereof; and a coolant selected from the group consisting of clay, silica, glass, and alumina, and mixtures thereof;

wherein the ammonium nitrate is phase stabilized by coprecipitating with potassium nitrate, said nitroguanidine comprises 1%–26% by weight of said mixture, said at least one nonazide high-nitrogen fuel comprises 4%–40% by weight of said mixture, said nitroguanidine in combination with said at least one nonazide high nitrogen fuel comprises 15%–60% by weight of said mixture, said phase stabilized ammonium nitrate comprises 40–85% by weight of said mixture, said burn rate modifier comprises 0–10% by weight of said mixture, and said coolant comprises 0–10% by weight of said mixture.

11. A gas generant composition consisting of a hydrated or anhydrous mixture of:

nitroguanidine and at least one nonazide high-nitrogen fuel selected from the group consisting of 1-, 3-, 5-substituted nonmetal salts of triazoles, and 1-, 5-substituted nonmetal salts of tetrazoles, said salts substituted at each position with a nitrogen-containing compound;

phase stabilized ammonium nitrate as an oxidizer, a burn rate modifier selected from the group consisting of alkali, alkaline earth, and transitional metal salts of tetrazole and triazole, triaminoguanidine nitrate, dicyandiamide, alkali and alkaline earth metal salts of dicyandiamide; alkali and alkaline earth borohydrides, and mixtures thereof; and a coolant selected from the group consisting of clay, silica, glass, and alumina, and mixtures thereof;

wherein the ammonium nitrate is phase stabilized by coprecipitating with potassium nitrate, said nitroguanidine comprises 1%–26% by weight of said mixture; said at least one nonazide high-nitrogen fuel comprises 4%–40% by weight of said mixture, said nitroguanidine in combination with said at least one nonazide high nitrogen fuel comprises 15%–60% by weight of said mixture, said phase stabilized ammonium nitrate comprises 40–85% by weight of said mixture, said burn rate modifier comprises 0–10% by weight of said mixture, and said coolant comprises 0–10% by weight of said mixture.

12. A gas generant composition consisting of a hydrated or anhydrous mixture of:

nitroguanidine, diammonium salt of 5,5'-bis-1H-tetrazole, phase stabilized ammonium nitrate as an oxidizer, wherein the ammonium nitrate is phase stabilized by coprecipitating with potassium nitrate, said nitroguanidine comprises 1%–26% by weight of said mixtures said diammonium salt of 5,5'-bis-1H-tetrazole comprises 4%40% by weight of said mixture, said nitroguanidine in combination with said diammonium salt of 5,5'-bis-1H-tetrazole comprises 15%–60% by weight of said mixture, and, said phase stabilized ammonium nitrate comprises 40–85% by weight of said mixture.

* * * * *